US006186440B1

(12) United States Patent
Yamakawa et al.

(10) Patent No.: US 6,186,440 B1
(45) Date of Patent: Feb. 13, 2001

(54) WIRE GUIDE NOZZLE, WIRE GUIDE NOZZLE UNIT AND DETACHING MECHANISM THEREOF

(75) Inventors: Nobuaki Yamakawa; Atsushi Hoshino, both of Shizuoka-ken (JP)

(73) Assignee: Yazaki Corporation, Tokyo (JP)

( * ) Notice: Under 35 U.S.C. 154(b), the term of this patent shall be extended for 0 days.

(21) Appl. No.: 09/317,109

(22) Filed: May 24, 1999

(30) Foreign Application Priority Data

May 25, 1998 (JP) ..... 10-143438

(51) Int. Cl.[7] ..... B65H 57/12

(52) U.S. Cl. ..... 242/615.3; 242/564.4; 29/741

(58) Field of Search ..... 242/615.3, 564.4; 29/741, 749, 755, 868

(56) References Cited

U.S. PATENT DOCUMENTS 5,611,141 3/1997 Takada et al. .
5,816,466 * 10/1998 Seufer ..... 242/615.3
5,945,635 * 8/1999 Suzuki et al. ..... 29/745
5,996,223 * 12/1999 Ogawa et al. ..... 29/861
6,045,023 * 4/2000 Michard ..... 242/564.4

FOREIGN PATENT DOCUMENTS 2-263533 10/1990 (JP) .
9-221274 8/1997 (JP) .
9-330625 12/1997 (JP) .
10-3979 1/1998 (JP) .

* cited by examiner

*Primary Examiner*—John M. Jillions
(74) *Attorney, Agent, or Firm*—Oblon, Spivak, McClelland, Maier & Neustadt, P.C.

(57) ABSTRACT

A wire guide nozzle 1 is provided by a single member. The wire guide nozzle 1 is provided by a piece of long-size body 5 which has a nozzle 2 formed to penetrate the body 5 in the longitudinal direction and a wire check pin 4 assembled so as to cross the nozzle 2 and slide in the lateral direction. Provided at proper intervals in the longitudinal direction of the long-size body 5 are a plurality of wire nipping spaces 6, 7, 8 which allow rollers for interposing a wire 3 to enter the spaces.

9 Claims, 9 Drawing Sheets

WIRE GUIDE NOZZLE, WIRE GUIDE NOZZLE UNIT AND DETACHING MECHANISM THEREOF

BACKGROUND OF THE INVENTION

1. Field of the Invention

The present invention relates to a wire guide nozzle which is usable for feeding a wire into a wire measuring apparatus in a manufacturing installation for producing wire harness to be arranged in e.g. an automobile. Further, the invention relates to a wire guide nozzle unit and an attachment and detachment mechanism for the wire guide nozzle.

2. Description of Related Art

Japanese Unexamined Patent Publication (kokai) No. 2-263533 discloses a conventional wire guide nozzle.

This wire guide nozzle assembly includes a first guide nozzle, a second guide nozzle on the front side of the first guide nozzle as a center and a third guide nozzle on the rear side of the first guide nozzle. The first guide nozzle is straight connected with the second guide nozzle through a connecting rod, while the first guide nozzle is straight connected with the third guide nozzle through another connecting rod. Provided between the first guide nozzle and the second guide nozzle is a wire holding section which includes a pair of opposing feed rollers. Also, another wire holding section having a plurality of calibration rollers is defined between the first guide nozzle and the third guide nozzle.

The first guide nozzle is provided with a wire pusher pin which penetrates the nozzle. The wire pusher pin has a wire through hole formed at the intermediate portion and a coil spring disposed on the base portion. When the wire guide nozzle assembly is not in use, an electrical wire inserted into the wire through-hole is urged against the inner wall of the nozzle by the wire pusher pin, in order to prevent the wire from being withdrawn from the wire through-hole. When the wire guide nozzle assembly is in use, that is, a pair of opposing feed rollers are closed to each other, then a release lever on the opposite side of the coil spring acts to press back a leading end of the wire pusher pin in opposition to the force of the coil spring, thereby allowing the wire to be fed. In this way, the wire is fed to a wire measuring apparatus.

Under condition that the first and third guide nozzles are fixed on profile members respectively fixed on two timing belts through bolts, a plurality of wire guide nozzles are arranged mounted in the longitudinal direction of the timing belts at regular intervals.

However, the above-mentioned wire guide nozzle assembly has the following problems to be solved due to the structure where three pieces of guide nozzles are assembled to each other through two connecting rods.

First, it should be noted that there is a difficulty of assembling three guide nozzles in a straight line. When the nozzles are not assembled in the straight line, then the rollers moving in the wire supporting area interfere with the guide nozzles, so that the guide nozzles may be damaged or the wire may be fed inappropriately.

Additionally, because of the structure composed of five components, there is a possibility that the components are mutually deviated from each other when a worker handles the wire guide nozzle. For this reason, the above-mentioned wire guide nozzle assembly has not been handled as a single unit and therefore, it has been used on condition that it is fixed to the above-mentioned timing belts. Under such a situation, it is impossible to apply so-called "outside setting" on the conventional wire guide nozzle assembly in advance. For example, when the wires have to be exchanged due to the required change in wire's color or diameter, the operation of machines (e.g. measuring apparatus) has to be stopped to withdraw or insert the wires. In such a case, the availability factor of the machine will be reduced. It should be noted that, under the reduced availability factor of the machine, the more the number of wires requiring to be exchanged is increased, the more seriously the productivity is influenced.

SUMMARY OF THE INVENTION

Under such a circumstance, it is therefore an object of the present invention to provide a wire guide nozzle, a wire guide nozzle unit and an attachment and detachment mechanism, all of which are capable of solving the above-mentioned various problems caused by such a poor assembly, and which are capable of the above "outside setting" thereby to improve the productivity.

The object of the present invention described above can be accomplished by a wire guide nozzle for guiding a wire being fed to a wire measuring apparatus, the wire guide nozzle comprising:

a long-size body having a path formed to penetrate therein in a longitudinal direction of the long-size body, the path allowing the wire to pass through the long-size body; and a wire check pin provided for preventing the wire from being withdrawn from the long-size body when the wire guide nozzle is not in use, the wire check pin being installed in the long-size body so as to slide in a lateral direction of the long-size body and cross the path;

wherein the long-size body is provided, at appropriate intervals in the longitudinal direction, with a plurality of wire nipping spaces each of which allows opposing rollers to enter, the rollers being provided for nipping the wire being inserted into the path.

According to the invention, since the path for guidance of the wire is formed to penetrate the long-size body in the longitudinal direction, it is possible to provide the whole wire guide nozzle without requiring any assembling but assembling the wire check pin into the long-size body. Furthermore, the straightness of the path can be maintained at the time of using the single wire guide nozzle.

Additionally, since the plural number of wire nipping spaces are formed in the single long-size body, it is possible to bring the wire guide nozzle into a position where the interference with the rollers for nipping the wire is avoided, with high accuracy. Further, even when using the wire guide nozzle as a single component, it is possible to maintain the position of the nozzle.

In the present invention mentioned above, preferably, the wire nipping spaces are provided for rollers for feeding the wire, rollers for measuring a length of the wire and rollers for detecting a joint formed in the wire, respectively.

Also in this case, it is possible to bring the wire guide nozzle into a position where the interference with the feed rollers, the measuring rollers and the joint-detecting rollers is avoided, with high accuracy. Further, even when using the wire guide nozzle as a single component, it is possible to maintain the position of the nozzle.

According to the invention, there is also provided a wire guide nozzle unit comprising:

a plurality of wire guide nozzles for guiding wires being fed to a wire measuring apparatus, each of the wire guide nozzles including:

a long-size body having a path formed to penetrate therein in a longitudinal direction of the long-size body, the path allowing the wire to pass through the long-size body; and a wire check pin provided for preventing the wire from being withdrawn from the long-size body when the wire guide nozzle is not in use, the wire check pin being installed in the long-size body so as to slide in a lateral direction of the long-size body and cross the path;

wherein the long-size body is provided, at appropriate intervals in the longitudinal direction, with a plurality of wire nipping spaces each of which allows opposing rollers to enter, the rollers being provided for nipping the wire being inserted into the path; and a nozzle base detachably mounted on a base holder of the wire measuring apparatus, the base holder being provided so as to move up and down intermittently in accordance with respective wire introducing positions that the wire measuring apparatus can occupy;

wherein the wire guide nozzles are detachably attached to the nozzle base so as to be parallel with each other in a direction perpendicular to the moving direction of the base holder, at intervals coinciding with the intermittent movement of the base holder.

With the above-mentioned arrangement, the outside setting can be carried out under condition that the plural number of wire guide nozzles where the wires in different colors or diameters are inserted into the paths, are attached to the nozzle base. Therefore, if there occurs a necessity of using different wires in color or diameter on the basis of the design change for the wire harness, it will be possible to easily meet the necessity by attaching the wire guide nozzle unit, which has been subjected to the previous outside setting on the assumption of such a design change, to the base holder.

In the above-mentioned wire guide nozzle unit, it is preferable that the wire guide nozzles attached to the nozzle base have a plurality of wires inserted into the respective paths, the wires constituting a wire harness to be produced.

In the above case, it is possible to execute the outside setting of every wire harness being produced.

More preferably, the wire guide nozzle unit further comprises a grip part attached to the nozzle base, for facilitating a worker's handling of the wire guide nozzle unit.

Furthermore, there is also provided an attachment and detachment mechanism for a wire guide nozzle unit which comprises:

a plurality of wire guide nozzles for guiding wires being fed to a wire measuring apparatus, each of the wire guide nozzles including:

a long-size body having a path formed to penetrate therein in a longitudinal direction of the long-size body, the path allowing the wire to pass through the long-size body; and a wire check pin provided for preventing the wire from being withdrawn from the long-size body when the wire guide nozzle is not in use, the wire check pin being installed in the long-size body so as to slide in a lateral direction of the long-size body and cross the path;

wherein the long-size body is provided, at appropriate intervals in the longitudinal direction, with a plurality of wire nipping spaces each of which allows opposing rollers to enter, the rollers being provided for nipping the wire being inserted into the path; and a nozzle base detachably mounted on a base holder of the wire measuring apparatus, the base holder being provided so as to move up and down intermittently in accordance with respective wire introducing positions that the wire measuring apparatus can occupy;

wherein the wire guide nozzles are detachably attached to the nozzle base so as to be parallel with each other in a direction perpendicular to the moving direction of the base holder, at intervals coinciding with the intermittent movement of the base holder;

the attachment and detachment mechanism comprising:

an end plate mounted on the lower end of the base holder, for supporting the lower end of the nozzle base;

a claw part mounted on the upper end of the base holder, for disengageably engaging with the upper end of the nozzle base being supported by the end plate;

an urging unit mounted on the base holder, for urging the claw part for engagement with the upper end of the nozzle base by force of spring; and an engagement releasing unit which is arranged so as to coincide with the urging unit in process of the base holder's upward and downward movement and which allows the claw part to move in the direction to release the engagement with the nozzle base at the coincidence position, in opposition to the force of spring.

In the attachment and detachment mechanism, the departure of the wire guide nozzle unit from the base holder can be attained in the only coincident position where the urging unit coincides with the engagement releasing unit in process of moving the base holder upward and downward. It is noted that, in the coincident position, the drive of the engagement releasing unit allows the claw part to shift to a direction to release the engagement of the wire guide nozzle unit with the base holder in opposition to the spring force, whereby the wire guide nozzle unit can be separated from the base holder. On the other hand, when the driving of the engagement releasing unit is stopped, the claw part can be returned to the original engagement position due to the spring force. Therefore, it is also possible to attach a new wire guide nozzle unit to the base holder.

In the above-mentioned mechanism, it is preferable that the urging unit includes a link part having one end pivoted to the base holder and another end pivoted to a connecting rod associated with the claw part and a spring for urging the link part in a direction to reduce a space between both ends of the link part and that the engagement releasing unit includes a release cylinder for pressing the link part in a direction to increase the space between both ends of the link part.

In this case, the claw part is connected to the link part through the connecting rod and urged in the direction for its engagement, by the spring. Owing to the press of the release cylinder, the link part is capable of expanding in the direction to increase the space in opposition to the spring force, so that the claw part can be rotated to the direction to release the engagement.

In the above-mentioned mechanism, more preferably, the link part includes a pair of link arms pivoted to each other and a link roller attached at a pivot point of the link arms and adapted so as to roll in contact with a fixed base and additionally, the release cylinder has a press end arranged in an identical plane with a surface of the fixed base abutting against the link roller.

In this case, since the link roller comes in contact with the fixed base, it is possible to restrict the space between both ends of the link part from being excessively reduced by the spring. Then, the upward and downward movement of the base holder can be ensured by the rolling operation of the link roller on the fixed base. Additionally, by the rolling operation of the link roller with the movement of the base holder, the link part can reach the press end of the releasing cylinder smoothly and the space between the ends of the link part can be certainly increased because the link roller in the coincident position usually comes into contact with the press end.

It is also preferable that the claw part is provided with a tapered surface which allows the claw part to rotate in a direction to disengage the claw part from the nozzle base in opposition to the force of spring when the upper end portion of the claw part comes into slide contact with an upper end of the nozzle base being urged against the claw part.

In this case, the wire guide nozzle unit can be attached to the base holder in all positions in the base holder's movement, without being limited to the above coincident position between the urging unit and the engagement releasing unit. Furthermore, the attaching of the unit can be easily carried out by simply pushing the upper end of the nozzle base into the claw part.

These and other objects and features of the present invention will become more fully apparent from the following description and appended claims taken in conjunction with the accompany drawings.

BRIEF DESCRIPTION OF THE DRAWINGS

FIG. 1A is a front view of the wire guide nozzle and FIG. 1B is a side view of the wire guide nozzle in use;

DESCRIPTION OF THE PREFERRED EMBODIMENT

An embodiment of the present invention will be described with reference to the accompanying drawings.

Figure 1A:
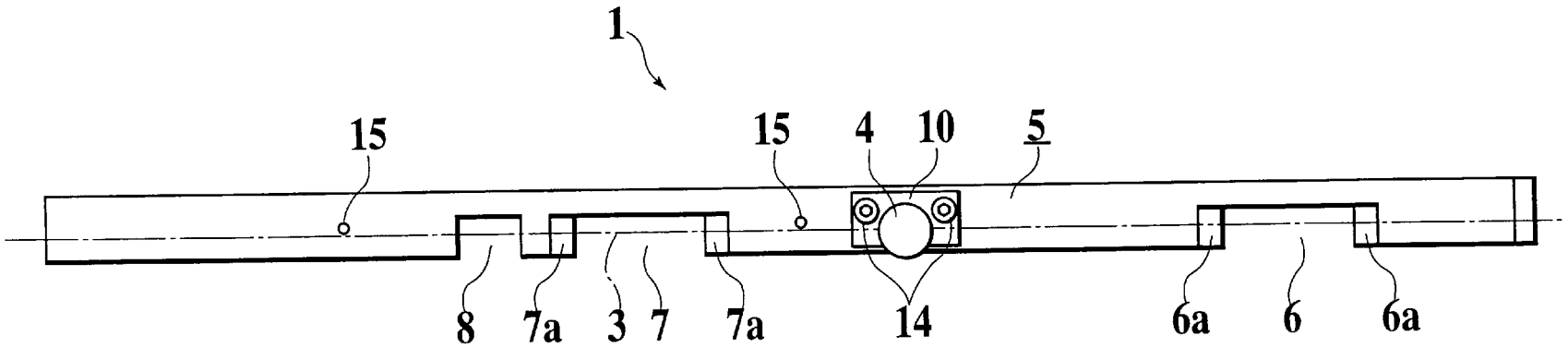
FIGS. 1A and 1B show a wire guide nozzle in accordance with an embodiment of the invention.
Figure 1B:
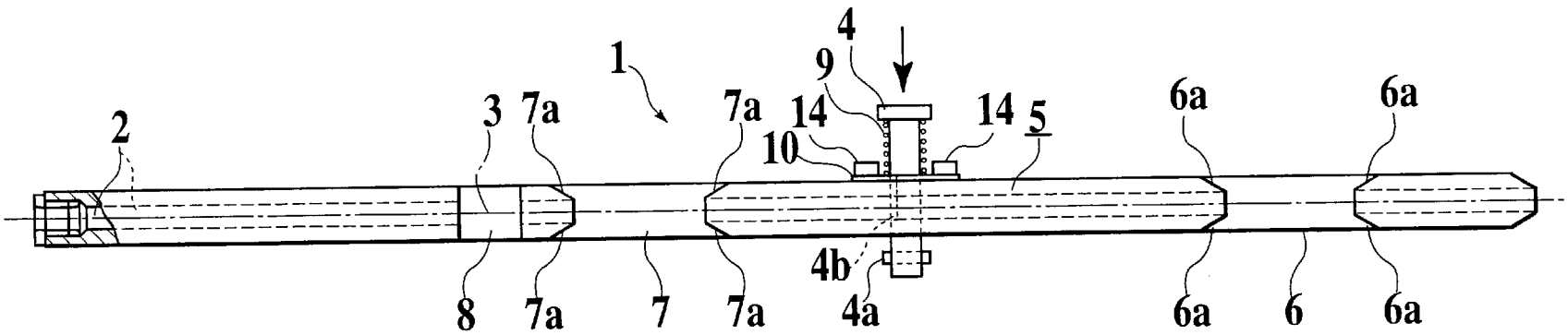
Figure 2:
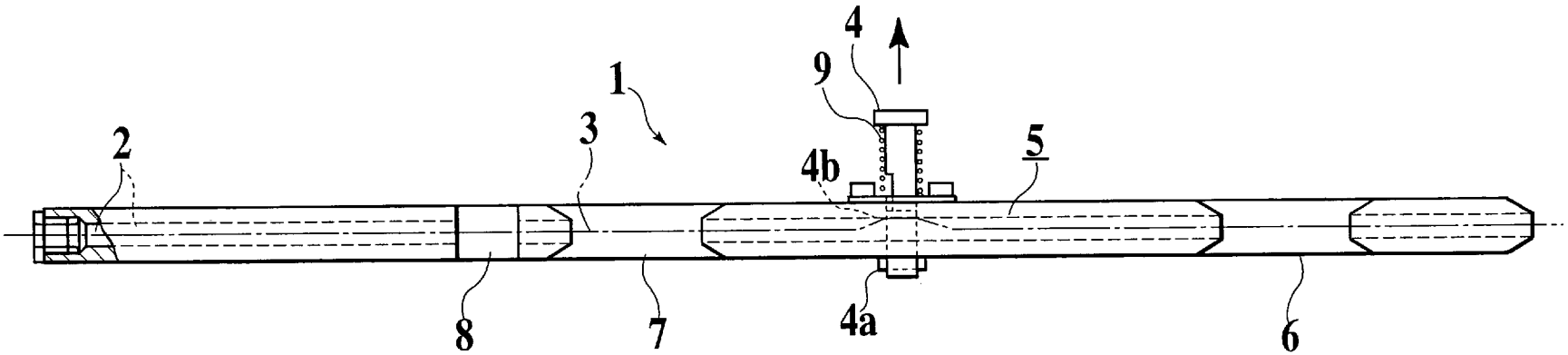
FIG. 2 is a side view of the wire guide nozzle of FIG. 1 in not use.

FIGS. 1 and 2 designate a wire guide nozzle 1 in accordance with the embodiment of the invention. The wire guide nozzle 1 is generally constituted so as to allow the wire 3 being fed to a measuring device 50 (see FIGS. 6 and 7) to insert into a nozzle (or a path for wire) 2 and to prevent the wire 3 from being withdrawn from the nozzle 2 by a wire check pin 4 when the nozzle 1 is not used.

The nozzle 2 is formed so as to penetrate a piece of long-size body 5 in the longitudinal direction, while the wire check pin 4 is assembled so as to intersect with the nozzle 2 and slide in the lateral direction. At appropriate intervals of the long-size body 5 in the longitudinal direction, there are provided a plurality of wire nipping spaces 6, 7, 8 into which rollers for nipping the wire 3 being inserted into the nozzle 2 can enter.

Figure 6:
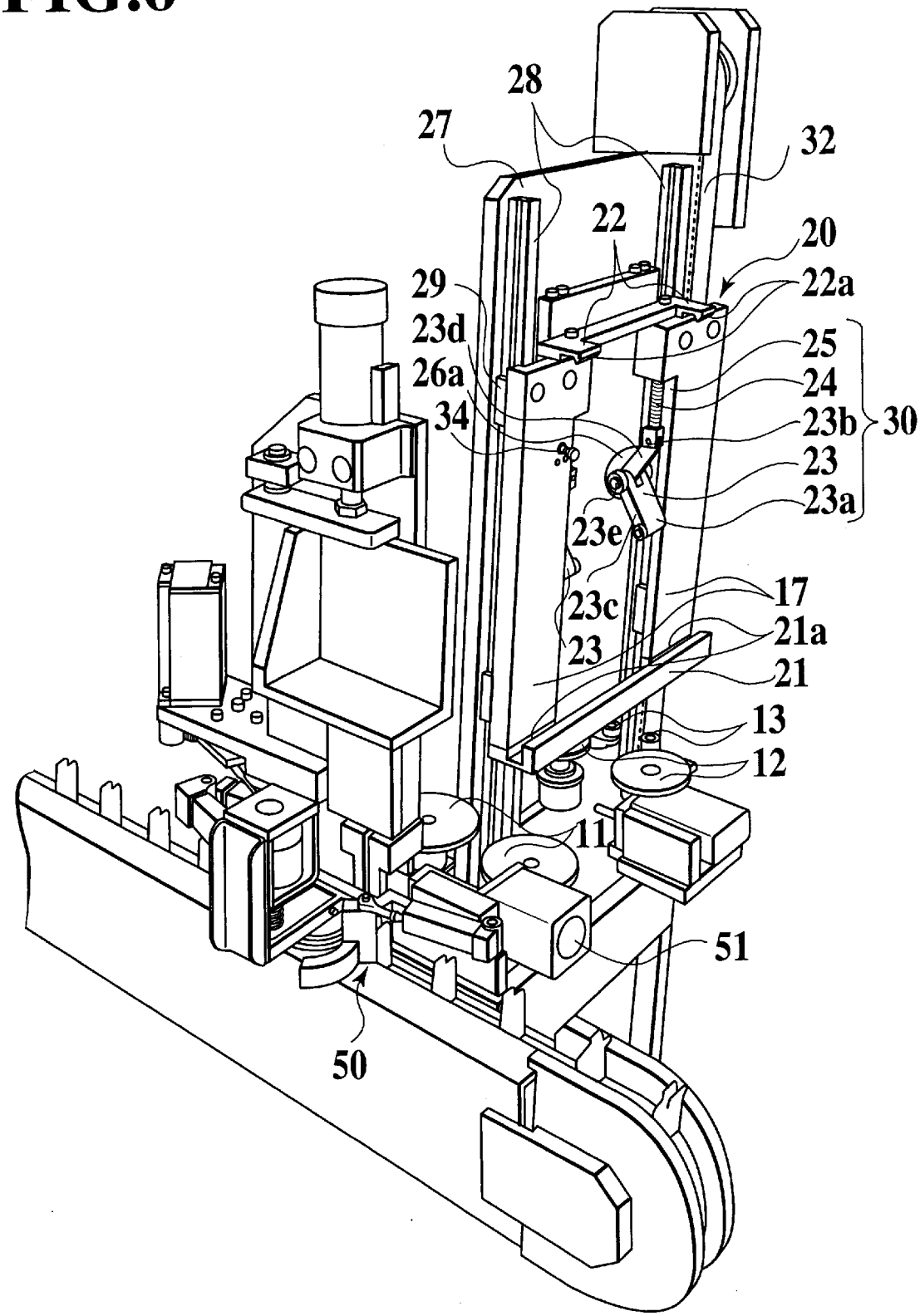
FIG. 6 is a perspective view of an essential part of a wire harness production apparatus equipped with the wire guide nozzle unit of FIG. 3, showing a condition that the wire guide nozzle unit is detached.
Figure 7:
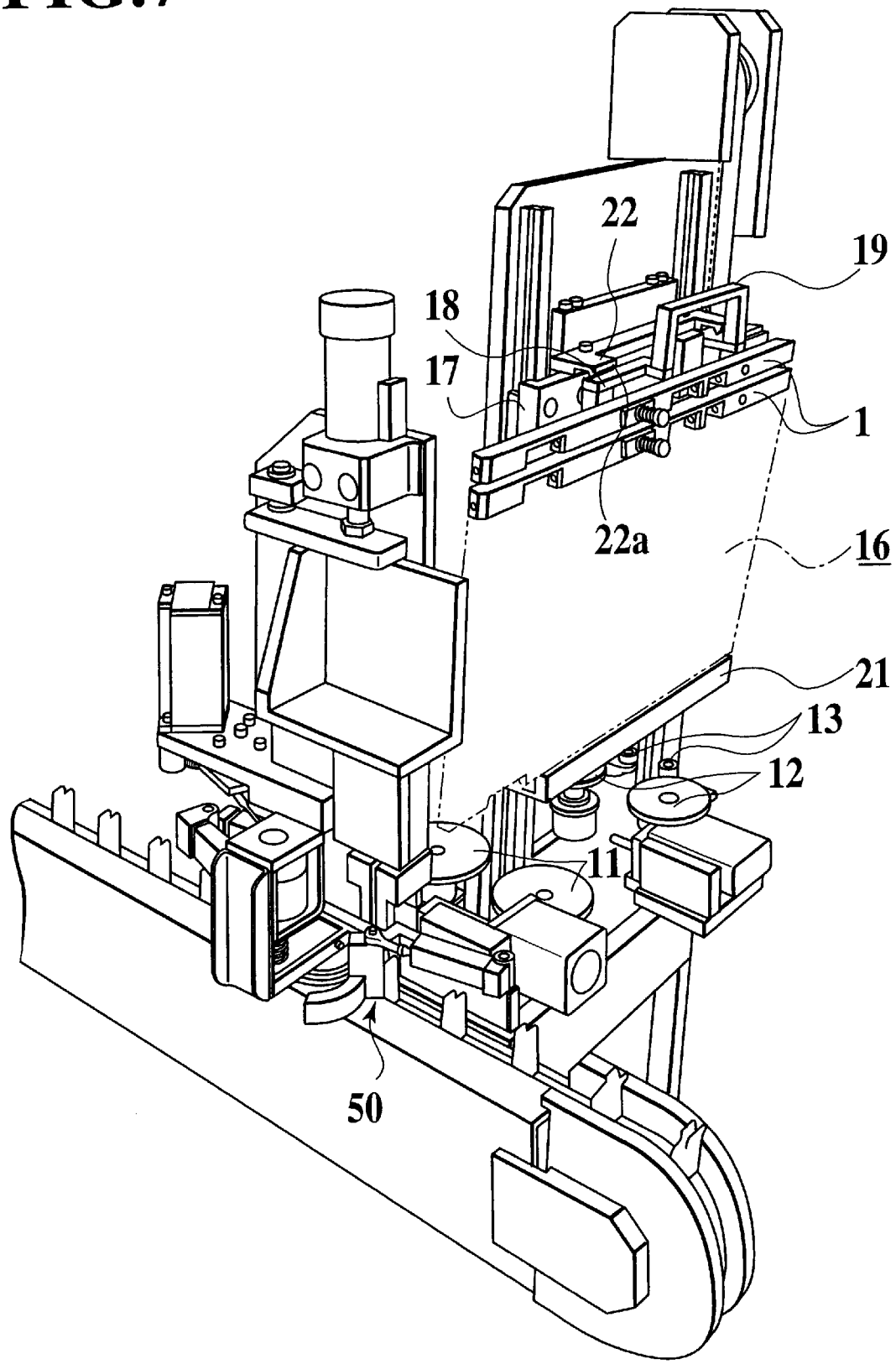
FIG. 7 is a perspective view of an essential part of a wire harness production apparatus equipped with the wire guide nozzle unit of FIG. 3, showing a process of attaching the wire guide nozzle unit.
Figure 8:
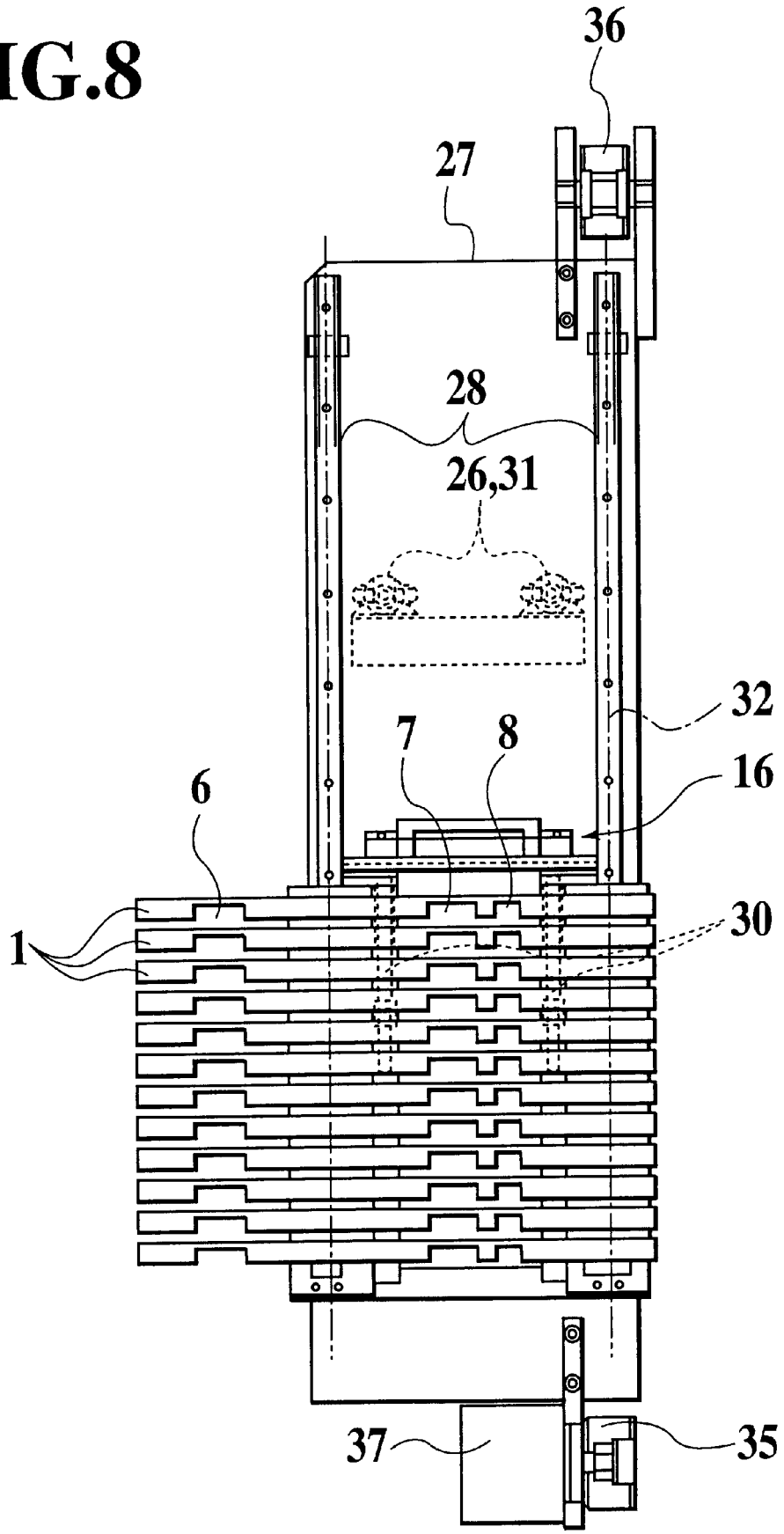
FIG. 8 is a schematic front view of the wire harness production apparatus equipped with the wire guide nozzle unit of FIG. 3.
Figure 9:
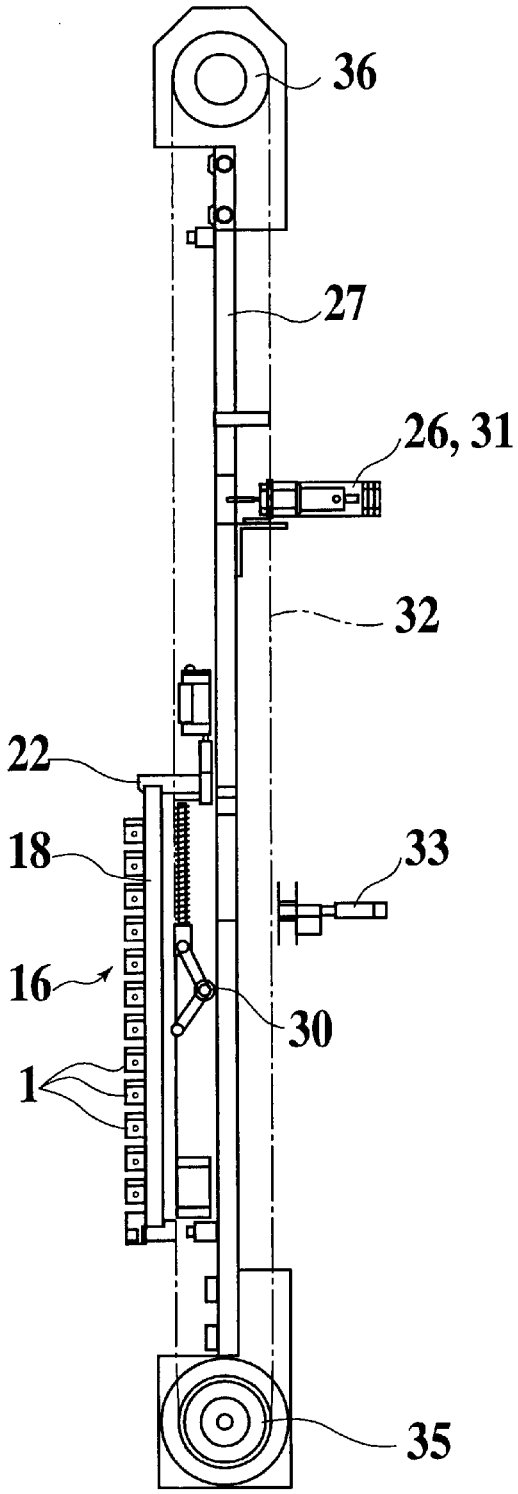
FIG. 9 is a schematic side view of the wire harness production apparatus.

According to the embodiment, the wire nipping space 6 is provided for feeding rollers 11, the wire nipping space 7 for measuring rollers 12, and the wire nipping space 8 is provided for joint detection rollers 13 (see FIGS. 6 and 7).

The long-size body 5 is formed as a rod body having a rectangular cross section, made of aluminum alloy, for example. The nozzle 2 is formed so as to penetrate through a general center of the rectangular cross section of the long-size body 5. The wire check pin 4 is provided, at a center thereof, with a wire through-hole 4*b*. A coil spring 9 is also arranged on the base part of the pin 4. Further, the wire check pin 4 has a tip portion equipped with a diametrical slip-proof pin 4*a* portion. The wire check pin 4 is prevented from swiveling by a baffle (whirl-stop) plate 10 and positioned at a substantially-intermediate position of the long-size body 5 in the longitudinal direction.

The baffle plate 10 is fixed on the outer face of the body 5 through screws 14, while the wire check pin 4 is restricted from rotating due to its engagement with a different-shaped orifice (not shown) formed in the baffle plate 10.

The wire nipping spaces 6, 7, 8 are provided by respectively forming substantial U-shaped notches in the long-size body 5, corresponding to the size and mutual intervals of the rollers 11, 12, 13. Additionally, the long-size body 5 is provided, on both sides of the wire nipping space 6, with tapered faces 6*a* for avoiding the interference with the feed rollers 11. Similarly, the long-size body 5 is also provided, on both sides of the wire nipping space 7, with tapered faces 7*a* for avoiding the interference with the measuring rollers 12. Note, in FIG. 1A, reference numerals 15 designate screw holes for mounting the nozzle 1.

When the wire guide nozzle 1 is not in use (FIG. 2), the wire 3 passing through the wire through-hole 4*b* is urged against the inner wall of the nozzle 3, so that the wire 3 can be prevented from being drawn out of the hole 4*b*. When the wire guide nozzle 1 is in use (FIG. 1B), that is, in case of closing the pair of feed rollers 11, 11, the wire check pin 4 is pushed back in opposition to the coil spring 9, by an external actuator (not shown) arranged on either side of the pin 4 or manually (in the direction of arrow of FIG. 1B), thereby allowing the wire 3 to be fed. Owing to the feeding, the wire 3 is fed into the measuring apparatus 50, while a length of the wire 3 is measured by the measuring rollers 12, 12 closing together with the feed rollers 11, 11. Note, during this operation, the joint detection rollers 13, 13 are simultaneously closed to interpose the wire 3 therebetween.

In the so-constructed wire guide nozzle 1, owing to the arrangement where the nozzle 2 for guiding the wire 3 is formed so as to penetrate the long-size body 5 in the longitudinal direction, it is possible to provide the whole wire guide nozzle 1 without requiring any assembly but the assembling of the wire check pin 4 in the long-size body 5 and maintain the straightness of the nozzle 2 at the time of handling of the wire guide nozzle 1 as a single component.

Additionally, since the wire nipping spaces 6, 7, 8 are arranged in the single long-size body 5, it is possible to arrange the nozzle 1 in a position where the interference with the feed rollers 11, the measuring roller 12 and the joint inspection rollers 13 is avoided, with high accuracy. Further, it is possible to maintain the position of the nozzle 1 at the time of handling it as a single component.

Therefore, the wire guide nozzle 1 of the embodiment is capable of solving a variety of problems due to the poor assembling occurring in the conventional wire guide nozzle. Additionally, since the invention allows the wire guide nozzle to be used as the single component, it is possible to improve the productivity by the adoption of exterior setting.

Figure 3:
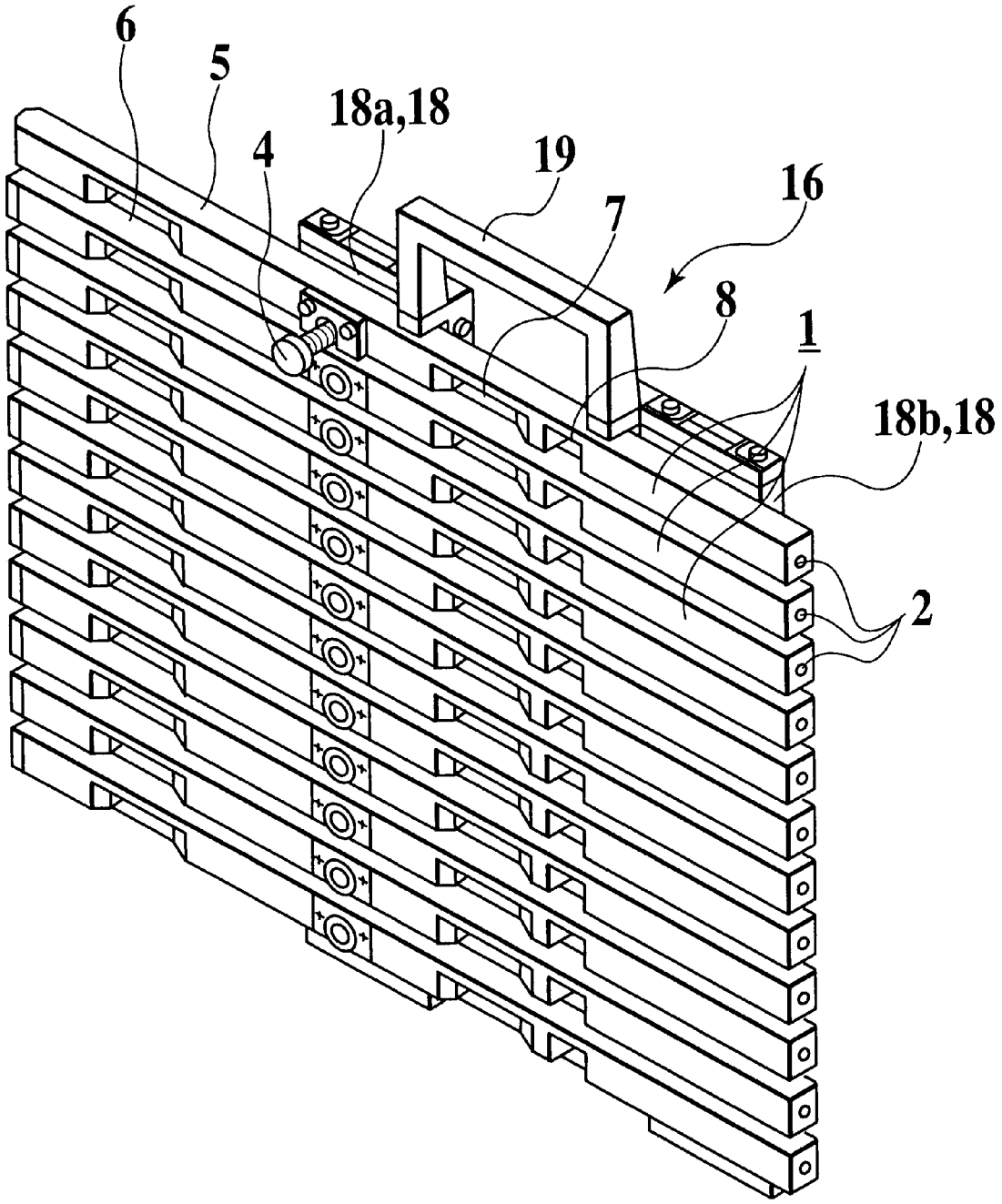
FIG. 3 is a perspective view of a wire guide nozzle unit in accordance with one embodiment of the invention.
Figure 4:
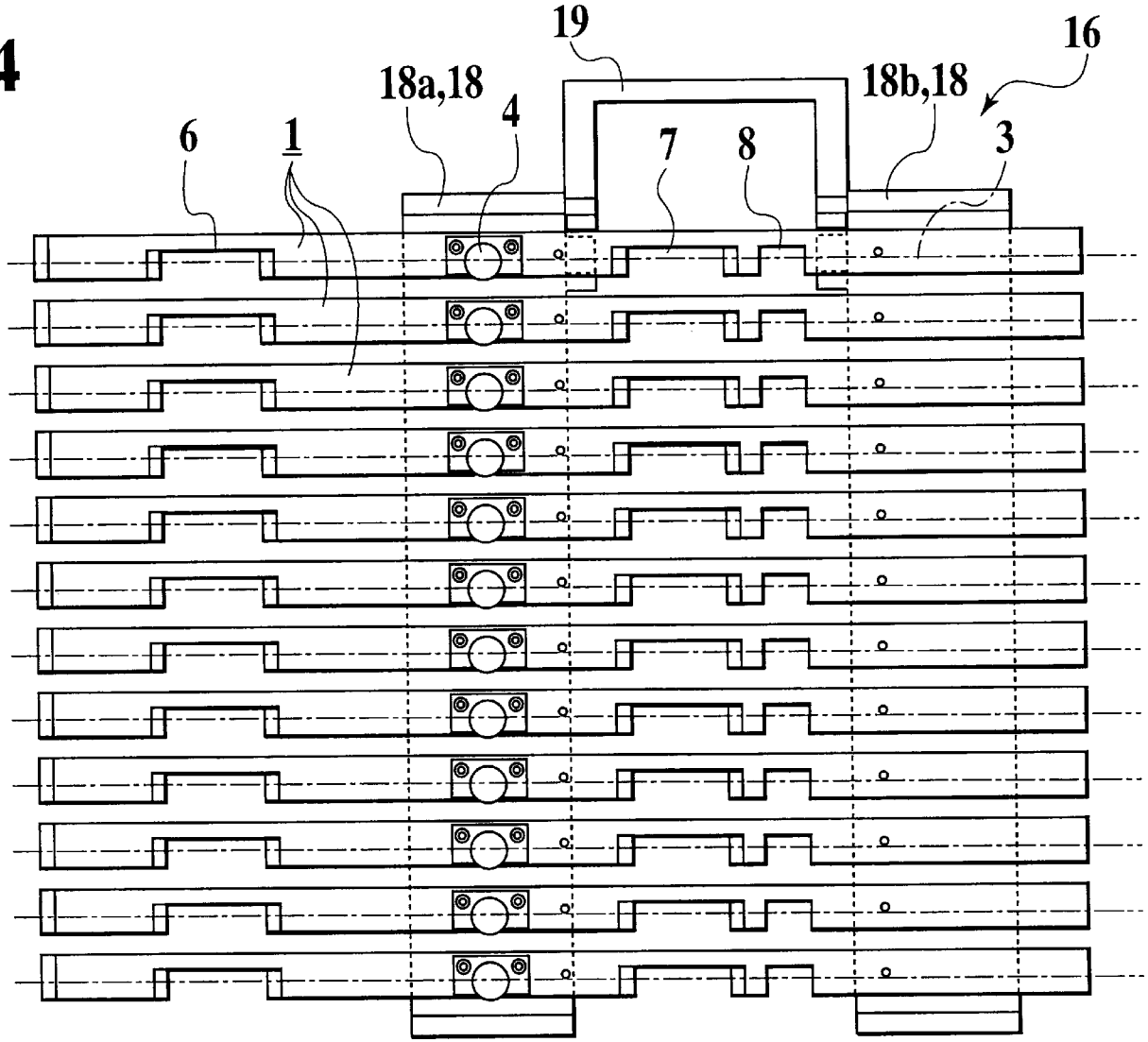
FIG. 4 is a front view of the wire guide nozzle unit of FIG. 3.
Figure 5:
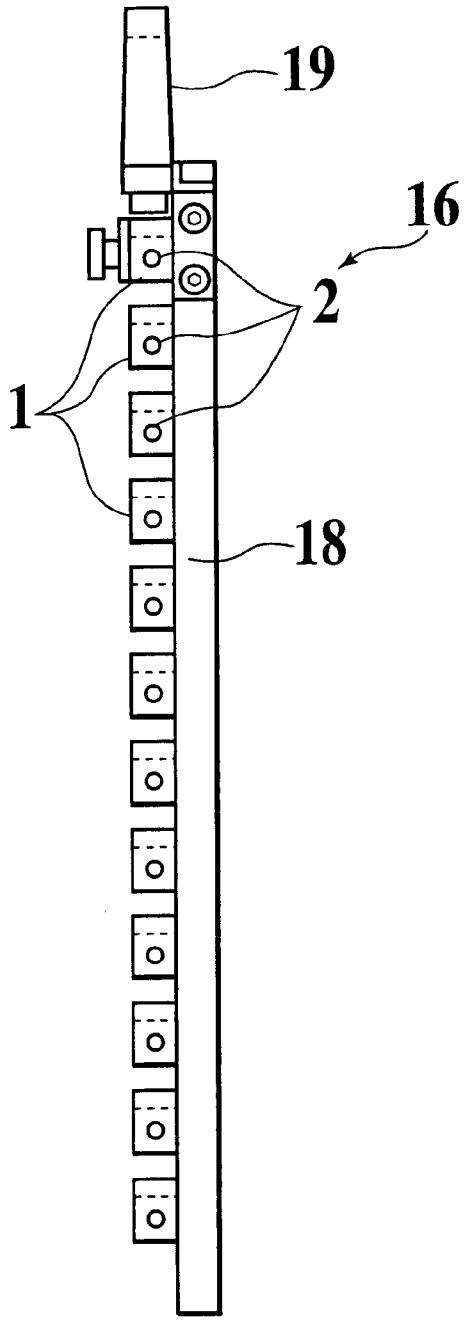
FIG. 5 is a side view of the wire guide nozzle unit of FIG. 3.

FIGS. 3 to 5 show a wire guide nozzle unit 16 in accordance with an embodiment of the invention. The wire guide nozzle unit 16 is composed of a plurality of wire guide nozzles 1 mentioned above.

In detail, the wire guide nozzle unit 16 comprises a nozzle base 18 which is detachably mounted on a base holder 17 (see FIGS. 6 and 7) intermittently moving up and down in accordance with a wire introducing position of the measuring apparatus 50, and the plural wire guide nozzles 1, 1, 1 . . . which are detachably attached on the nozzle base 18 so as to be parallel with each other in a direction perpendicular to the movement of the base holder 17, at intervals to coincide with the intermittent movement of the base holder 17.

The nozzle base 18 is constituted by two pieces of long plate members 18*a*, 18*b*. Preferably, as the present embodiment does, the nozzle base 18 is provided with a grip part 19. The grip part 19 has both ends fixed on the top ends of the plate members 18*a*, 18*b*, respectively and is arranged so as to bridge over the members 18*a*, 18*b*.

The wire guide nozzles 1 are detachably mounted on the nozzle base 18 since they are screwed up to the plate members 18*a*, 18*b* through the screw holes 15. In this arrangement, the position and posture of each wire guide nozzle 1 is adjusted so that the wire check pin 4 occupies the opposite side of the plate member 18*a* while the wire nipping spaces 6, 7, 8 open downward and that the spaces 7, 8 exist between two plate members 18*a*, 18*b* while the remaining space 6 exists outside the plate member 18*a*.

Preferably, the plural wire guide nozzles 1, 1, . . . , attached to the nozzle base 18 are constructed so as to insert the plural wires 3 constituting a wire harness being produced, into the nozzles 2. In this embodiment, the wire guide nozzle unit 16 has twelve wire guide nozzles 1 attached to the nozzle base 18 in order to produce a wire harness composed of twelve wires 3.

In the so-constructed wire guide nozzle unit 16, it is possible to attach the plural wire guide nozzles 1, 1, . . . , which insert the different wires 3 in color or diameter into the nozzles 2, to the nozzle base 18 for the outside setting. Thus, even when there is occurred a necessity of employing the different wires 3 in color, diameter, or the like, on the ground of changing the design of wire harness etc., it would be possible to cope with the design change easily with the attachment of the wire guide nozzle unit 16, which has been previously established in response to the expected design change, to the base holder 17. According to the embodiment, the above-mentioned outside setting can be carried out for every wire harness being produced.

Furthermore, owing to the provision of the grip part 19 facilitating the handling, the worker can move the wire guide nozzle unit 16 in order to attach it to or detach it from the base holder 17 with ease.

Note, as a matter of course, the number of wire guide nozzles 1 constituting the nozzle unit 16 can be increased or reduced as occasion demands. Thus, the wire guide nozzle unit 16 may be constituted by e.g. six nozzles, twenty four nozzles, ninety nozzles, or the like.

FIGS. 6 to 9 show an attachment/detachment mechanism 20 for the wire guide nozzle unit 16 in accordance with one embodiment of the invention. The mechanism 20 is provided for detachably attaching the unit 16 to the base holder 17.

The attachment/detachment mechanism 20 comprises an end plate 21 mounted on the lower end of the base holder 17, for supporting the lower end of the nozzle base 18, claw parts 22 mounted on the upper end of the base holder 17, for engagement with the upper end of the nozzle base 18 being supported by the end plate 21, an urging unit 30 mounted on the base holder 17, for urging the claw parts 22 for engagement with the upper end of the nozzle base 18 by spring force and an engagement releasing unit 31 which is arranged so as to coincide with the urging unit 30 in process of the base holder's moving up and down and which allows the claw parts 22 to move in the direction to release the engagement with the nozzle base 18 at the above coincidence position, in opposition to the spring force.

The base holder 17 is constituted by two long plate bodies which are adapted so as to slide on guide rails 28, 28 through respective sliders 29. The guide rails 28, 28 are arranged on both sides of a standing fixed base 27, vertically. Since the end plate 21 is attached to respective lower parts of the long plate bodies so as to connect them with each other, it may safely be said that the end plate 21 is provided on the base holder 17. Two plate bodies constituting the base holder 17 are connected to each other while maintaining an interval substantially equal to that separating two plate bodies 18*a*, 18*b* constituting the nozzle base 18. By engagement with the lower parts of the plate bodies, the end plate 21 does constitute a groove part 21*a* for supporting the nozzle base 18.

In the base holder 17, the plate body on one side is connected with a timing belt 32 wound over sprockets 35, 36 respectively attached to upper and lower parts of one side of the fixed base 27. Consequently, by a motor 37 for driving the sprocket 35, the base holder 17 is intermittently moved up and down so as to accord with the wire introducing positions that the measuring apparatus 50 can occupy.

The claw parts 22 are constituted by a single prism body which is attached to the base holder 17 so as to bridge the respective upper ends of two plate bodies of the holder 17. The prism body is provided, on both sides thereof, with two portions which project to the opposite side of the fixed base 27, thereby providing the above claw parts 22 corresponding to the plate bodies, respectively. Note, both ends of the prism body are pivotably born by the upper ends of two plate bodies constituting the base holder 17, respectively.

According to the attachment/detachment mechanism 20 mentioned above, the wire guide nozzle unit 16 is attached to the base holder 17 under condition that respective lower parts of two plate bodies 18*a*, 18*b* are fitted into the groove parts 21*a*, 21*a*, while respective upper parts of two plate bodies 18*a*, 18*b* are engaged with the claw parts 22, 22. Under this attachment condition, each wire guide nozzle 1 of the unit 16 has the wire nipping space 6 positioned outside the fixed base 27 and the wire nipping spaces 7, 8 both disposed between the plate bodies 18*a*, 18*b* of the nozzle base 18. (see FIG. 8)

The departure of the wire guide nozzle unit 16 from the base holder 17 can be attained in the only coincident position where the urging unit 30 coincides with the engagement releasing unit 31 in process of moving the base holder 17 upward and downward. In the coincident position, the drive of the engagement releasing unit 31 allows the claw parts 22 to shift to a direction to release the engagement of the unit 16 with the base holder 17 in opposition to the spring force, whereby the wire guide nozzle unit 16 can be separated from the base holder 17. On the other hand, when the driving of the engagement releasing unit 31 is stopped, the claw parts 22 can be returned to the original engagement position due to the spring force. In this way, it is also possible to attach a new nozzle unit 16 to the base holder 17.

Preferably, as shown in FIG. 7, each claw part 22 is provided with a tapered surface 22*a*. In operation, when the upper end of the nozzle base 18 supported by the end plate 21 is pushed against the claw part 22, then the upper end portion of the tapered surface 22*a* comes into slide contact with the nozzle base 18, so that the claw part 22 is rotated to the direction to release the engagement of the unit 16 with the base holder 17 in opposition to the spring force.

According to this preferable arrangement, the wire guide nozzle unit 16 can be attached to the base holder 17 in all positions in the base holder's movement, without being limited to the above coincident position between the urging unit 30 and the engagement releasing unit 31. Furthermore, the attaching of the unit 16 can be easily carried out by simply pushing the upper end of the nozzle base 18 into the claw parts 22.

We now describe a detailed structure of the urging unit 30 and the engagement releasing unit 31.

Corresponding to two claw parts 22, 22, the urging unit(s) 30 are provided for two plate bodies constituting the base holder 17. Each urging unit 30 includes a link part (or an articulated member) 23 having an end 23*a* pivoted to the base holder 17 and another end 23*b* pivoted to a connecting rod 24 associated with the claw part 22. The unit 30 further includes a spring 25 for urging the link part 23 in a direction to reduce a space between the end 23*a* and the other end 23*b* of the link part 23. Owing to the provision of the spring 25, the claw part 22 is urged in a direction to engage it with the upper end of the nozzle base 18 through the connecting rod 24.

Corresponding to two urging units 30, 30, two engagement releasing unit(s) 31 are provided on the fixed base 27. Each engagement releasing unit 31 is constituted by a release cylinder 26 for pressing the link part 23 in a direction to increase the space between the ends 23*a*, 23*b* of the link part 23. Owing to the press of the release cylinder 26, the link part 23 is capable of expanding in the direction to increase the space in opposition to the spring force, so that the claw part 23 can be rotated to the direction to release the engagement through the intermediary of the connecting rod 24.

Preferably, as shown in FIG. 6, each link part 23 includes a pair of link arms 23*c*, 23*d* pivoted to each other and a link roller 23*e*. The link roller 23*e* is attached at a pivot point of the link arms 23*c*, 23*d* and adapted so as to roll in contact with the fixed base 27. The release cylinder 26 is provided with a press end 26*a* in the same plane as a surface of the fixed base 27, which abuts against the link roller 23*e*.

According to the arrangement where the link roller 23*e* comes in contact with the fixed base 27, it is possible to restrict the space between both ends of the link part 23 from being excessively reduced by the spring 25. Then, the upward and downward movement of the base holder 17 can be ensured by the rolling operation of the link roller 23*e* on the fixed base 27. Additionally, by the rolling operation of the link roller 23*e* with the movement of the base holder 17, the link part 23 can reach the press end 26*a* of the releasing cylinder 26 smoothly and the space between the ends 23*a*, 23*b* can be certainly increased because the link roller 23*e* in the coincident position usually comes into contact with the press end 26*a*.

Note, in FIG. 6, reference numeral 34 designates a sensor for detecting the existence of the wire guide nozzle unit 16. In case of attaching the wire guide nozzle unit 16, the sensor 34 is pressed and activated by the plate body 18*a* of the nozzle base 18, thereby allowing the attachment of the unit 16 to be confirmed. Again in FIG. 6, reference numeral 51 designates a cylinder which drives a not-shown cutter of the measuring apparatus 50. By activating the cylinder 51, it is possible to cut the wire 3 fed through the feed rollers 11 at a predetermined length. Reference numeral 33 in FIG. 9 denotes a sensor for detecting the position of the base holder 17. In operation, the sensor 33 detects the base holder 17 occupying the coincident position of the urging unit 30 with the engagement releasing unit 31, thereby ensuring the operation of the engagement releasing unit 31.

According to the mechanism 20 mentioned above, the wire guide nozzle unit 16 can be attached to or detached from the base holder 17 with ease. In detail, if there is produced a necessity of using the different wires 3 in the color or diameter on the basis of the design change for the wire harness, it will be possible to easily meet the necessity by attaching the wire guide nozzle unit 16, which has been subjected to the previous outside setting on the assumption of such a design change, to the base holder 17, and the productivity will be improved as well.

Finally, it will be understood by those skilled in the art that the foregoing description is related to one preferred embodiment concerning the disclosed wire guide nozzle, the nozzle unit and the attachment/detachment mechanism and that various changes and modifications may be made to the present invention without departing from the scope thereof.

What is claimed is:

1. A wire guide nozzle for guiding a wire being fed to a wire measuring apparatus, the wire guide nozzle comprising:

an integral long-size body having a path extending through a length of the long-size body in a longitudinal direction of the long-size body, the path allowing the wire to pass through the long-size body; and a wire check pin provided for preventing the wire from being withdrawn from the long-size body when the wire guide nozzle is not in use, the wire check pin being installed in the long-size body so as to slide in a lateral direction of the long-size body and cross the path;

wherein the long-size body is provided, at appropriate intervals in the longitudinal direction, with a plurality of wire nipping spaces each of which allows opposing rollers to enter, the rollers being provided for nipping the wire being inserted into the path.

2. A wire guide nozzle as claimed in claim 1, wherein the wire nipping spaces are provided for rollers for feeding the wire, rollers for measuring a length of the wire and rollers for detecting a joint formed in the wire, respectively.

3. A wire guide nozzle unit comprising:

a plurality of wire guide nozzles for guiding wires being fed to a wire measuring apparatus, each of the wire guide nozzles including:

a long-size body having a path formed to penetrate therein in a longitudinal direction of the long-size body, the path allowing the wire to pass through the long-size body; and a wire check pin provided for preventing the wire from being withdrawn from the long-size body when the wire guide nozzle is not in use, the wire check pin being installed in the long-size body so as to slide in a lateral direction of the long-size body and cross the path;

wherein the long-size body is provided, at appropriate intervals in the longitudinal direction, with a plurality of wire nipping spaces each of which allows opposing rollers to enter, the rollers being provided for nipping the wire being inserted into the path; and a nozzle base detachably mounted on a base holder of the wire measuring apparatus, the base holder being provided so as to move up and down intermittently in accordance with respective wire introducing positions that the wire measuring apparatus can occupy;

wherein the wire guide nozzles are detachably attached to the nozzle base so as to be parallel with each other in a direction perpendicular to the moving direction of the base holder, at intervals coinciding with the intermittent movement of the base holder.

4. A wire guide nozzle unit as claimed in claim 3, wherein the wire guide nozzles attached to the nozzle base have a plurality of wires inserted into the respective paths, the wires constituting a wire harness to be produced.

5. A wire guide nozzle unit as claimed in claim 3, further comprising a grip part attached to the nozzle base, for facilitating a worker's handling of the wire guide nozzle unit.

6. An attachment and detachment mechanism for a wire guide nozzle unit which comprises:

a plurality of wire guide nozzles for guiding wires being fed to a wire measuring apparatus, each of the wire guide nozzles including:

a long-size body having a path formed to penetrate therein in a longitudinal direction of the long-size body, the path allowing the wire to pass through the long-size body; and a wire check pin provided for preventing the wire from being withdrawn from the long-size body when the wire guide nozzle is not in use, the wire check pin being installed in the long-size body so as to slide in a lateral direction of the long-size body and cross the path;

wherein the long-size body is provided, at appropriate intervals in the longitudinal direction, with a plurality of wire nipping spaces each of which allows opposing rollers to enter, the rollers being provided for nipping the wire being inserted into the path; and a nozzle base detachably mounted on a base holder of the wire measuring apparatus, the base holder being provided so as to move up and down intermittently in accordance with respective wire introducing positions that the wire measuring apparatus can occupy;

wherein the wire guide nozzles are detachably attached to the nozzle base so as to be parallel with each other in a direction perpendicular to the moving direction of the base holder, at intervals coinciding with the intermittent movement of the base holder;

the attachment and detachment mechanism comprising:

an end plate mounted on the lower end of the base holder, for supporting the lower end of the nozzle base;

a claw part mounted on the upper end of the base holder, for disengageably engaging with the upper end of the nozzle base being supported by the end plate;

an urging unit mounted on the base holder, for urging the claw part for engagement with the upper end of the nozzle base by spring force; and an engagement releasing unit which is arranged so as to coincide with the urging unit in process of the base holder's upward and downward movement and which allows the claw part to move in the direction to release the engagement with the nozzle base at the coincidence position, in opposition to the spring force.

7. An attachment and detachment mechanism as claimed in claim 6, wherein the urging unit includes:

a link part having one end pivoted to the base holder and another end pivoted to a connecting rod associated with the claw part; and a spring for urging the link part in a direction to reduce a space between both ends of the link part; and wherein the engagement releasing unit includes a release cylinder for pressing the link part in a direction to increase the space between both ends of the link part.

8. An attachment and detachment mechanism as claimed in claim 7, wherein the link part includes:

a pair of link arms pivoted to each other; and a link roller attached at a pivot point of the link arms and adapted so as to roll in contact with a fixed base; and wherein the release cylinder has a press end arranged in an identical plane with a surface of the fixed base abutting against the link roller.

9. An attachment and detachment mechanism as claimed in claim 6, wherein the claw part is provided with a tapered surface which allows the claw part to rotate in a direction to disengage the claw part from the nozzle base in opposition to the force of spring when the upper end portion of the claw part comes into slide contact with an upper end of the nozzle base being urged against the claw part.

* * * * *